US005564595A

United States Patent [19]

Minissian

[11] Patent Number: 5,564,595

[45] Date of Patent: Oct. 15, 1996

[54] CHEMICAL DISPENSING SYSTEM

[76] Inventor: Kevin G. Minissian, 1060 Bella Vista, Pasadena, Calif. 91107

[21] Appl. No.: 389,221

[22] Filed: Feb. 15, 1995

[51] Int. Cl.[6] ..... B67D 5/08

[52] U.S. Cl. ..... 222/59; 222/61; 222/136; 68/17 R; 134/99.1; 364/479.1

[58] Field of Search ..... 222/55, 59, 61, 222/63, 71, 14, 20, 132, 136, 148, 651; 18/17 R; 134/99; 364/479

[56] References Cited

U.S. PATENT DOCUMENTS

| | | | |
|---|---|---|---|
| 2,197,294 | 4/1940 | Brockbank | 222/59 |
| 2,841,176 | 7/1958 | Buss | 222/59 |
| 3,044,285 | 7/1962 | Koplin | 68/12.18 |
| 3,135,282 | 6/1964 | Gray | 137/114 |
| 3,786,835 | 1/1974 | Flager | 137/566 |
| 4,020,659 | 5/1977 | Bhavsar | 68/27 |
| 4,236,393 | 12/1980 | Katzfey | 68/27 |
| 4,335,591 | 6/1982 | Gillespie | 68/27 |
| 4,951,458 | 8/1990 | Steinort | 68/27 |
| 5,014,211 | 5/1991 | Turner et al. | 68/17 R |
| 5,246,026 | 9/1993 | Proudman | 137/101.19 |
| 5,435,157 | 7/1995 | Laughlin | 68/17 R |

*Primary Examiner*—Andres Kashnikow
*Assistant Examiner*—Philippe Dergkshani
*Attorney, Agent, or Firm*—Denton L. Anderson; Sheldon & Mak, Inc.

[57] ABSTRACT

An automatic chemical dispensing system is provided wherein a preselected quantity of liquid chemical drawn from one of several storage vessels is dispensed to one of several different receptacles using a single operating pump. The system includes a single remote controllable operating pump, remote controllable inlet and discharge valves, a single flow indicator and a liquid flush system. The system is controlled by a computerized controller. Piping linking the storage vessels, the pump and the receiving vessels is configured so that the operating pump draws a requested chemical from the appropriate storage vessel and pumps that chemical into a discharge header located between the pump and the receiving vessel. As the operating pump pumps the chemical into the discharge header, flow through the header is noted on the single flow indicator. When the requested amount of chemical is noted by the controller to have flowed through the flow indicator, a liquid flush header is opened and the discharge header is flushed into the receiving vessel with a flushing liquid, such as water. In a preferred embodiment, a gas flush system is connected to the discharge header downstream of the flow controller for more rapid injection of chemicals. The system uses no dilution manifold or flow orifices. Chemical and flushing liquid are rapidly and accurately delivered in essentially "plug flow" form directly into the receiving vessel.

20 Claims, 4 Drawing Sheets

CHEMICAL DISPENSING SYSTEM

FIELD OF THE INVENTION

This invention is directed to methods and apparatus systems for dispensing a plurality of liquid chemical products to one or more of a plurality of chemical receptacles.

BACKGROUND OF THE INVENTION

The dispensing of a plurality of liquid chemical products to one or more of a plurality of chemical receptacles is a common requirement of many industries, such as the laundry, textile and food processing industries. For example, in an industrial laundry facility, one of several operating washing machines will require, from time to time, aqueous solutions containing quantities of alkaloid, detergent, bleach, starch, softener and/or sour.

Increasingly, such industries have turned to automated methods and apparatus systems for dispensing liquid chemical products. Such automated methods and apparatus systems provide increased control of product use and minimize human contact with potentially hazardous chemicals.

The most common automatic chemical dispensing systems presently used in industry require a pump for each of the plurality of liquid chemical products. Generally, these pumps deliver raw chemical product to a dilution manifold where the chemical product is mixed with a diluent, typically water. The mixture is then pumped to a chemical product receptacle by a separate delivery pump. Such systems are relatively simple in concept, but they can be extremely expensive to build and operate. Since every chemical product storage vessel needs a separate pump to deliver it into the dilution manifold, where the number of chemical products deliverable by the system is large, capital, operating and maintenance costs can be enormous. Also, because such systems use dilution manifolds, such systems are often unacceptably slow, inaccurate and wasteful.

In U.S. Pat. No. 5,246,026, an "improved" chemical dispensing system is proposed which ostensibly requires only a single delivery pump. Chemical product is drawn from the individual chemical product storage vessels and into the dilution manifold by the delivery pump. Diluent is added to the dilution chamber and the resulting mixture is pumped via the delivery pump to the appropriate chemical receiving vessel. Such a system considerably decreases capital, operating and maintenance costs over older automated dispensing systems. However, even such an "improved" system entails continuing problems. For example, the system relies on flow monitoring devices which employ in-line flow orifices. Such orifices are inaccurate and require continuous monitoring. Also, such orifices can become plugged and are only accurate for particular viscosity ranges. To be able to handle a wide variety of materials having different viscosities, such orifices must be made adjustable. Such adjustability adds to the cost of installation and maintenance of the system. Furthermore, because the system requires a dilution manifold, the system remains relatively slow, inaccurate and wasteful. Finally, the system requires that one or both of the inputs to the dilution manifold be monitored with some form of flow indicator to properly control the resulting diluted mixture which is pumped to the chemical receiving vessel. This necessity to monitor the flow of one or more of the inputs to the dilution manifold requires the installation and maintenance of expensive flow monitoring equipment for that purpose.

Accordingly, there is a need for an automated chemical dispensing system that is faster, more reliable, less wasteful and less expensive to build, operate and maintain than prior art chemical dispensing systems.

SUMMARY OF THE INVENTION

The invention satisfies this need. The invention is a method and apparatus system for quickly and reliably dispensing a preselected quantity of liquid chemical drawn from one or more of a plurality of storage vessels and dispensing that quantity of liquid chemical to one of a plurality of receptacles using a single operating pump.

The invention comprises:

(a) a remote controllable operating pump having a suction side and a discharge side;

(b) a suction conduit having an upstream end, a midsection and a downstream end, the downstream end being in fluid tight communication with the suction side of the operating pump;

(c) a plurality of inlet conduits, each inlet conduit being adapted to receive a quantity of liquid chemical from one of the plurality of storage vessels and to discharge such quantity of liquid chemical to the midsection of the suction conduit;

(d) a plurality of remote controllable inlet valves, one inlet valve being operatively disposed within each inlet conduit for controlling liquid flow therein;

(e) a discharge conduit having an upstream end, a midsection and a downstream end, the upstream end being in fluid tight communication with the discharge side of the operating pump;

(f) a plurality of dispensing conduits, each dispensing conduit being adapted to receive a quantity of liquid chemical from the downstream end of the discharge conduit and to discharge such quantity of liquid chemical to one of the plurality of recepticals;

(g) a plurality of remote controllable dispensing valves, one dispensing valve being operatively disposed within each dispensing conduit for controlling liquid flow therein;

(h) a flow indicator operatively disposed within the upstream end of the discharge conduit for monitoring liquid flow therein, and generating a primary flow signal corresponding thereto;

(i) a liquid flush conduit having an upstream end and a downstream end, the upstream end being connected in fluid tight communication with a source of pressurized liquid and the downstream end being connected in fluid tight communication with the upstream end of the suction conduit;

(j) a remote controllable liquid flush valve operatively disposed within the liquid flush conduit for controlling liquid flow therein; and (k) a computerized controller programmed to (i) receive operating instructions regarding the transferring of a quantity of chemical from one of the storage vessels to one of the recepticals and to (ii) remotely control the dispensing system in accordance with the operating instructions by operating the inlet valves, the operating pump, the dispensing valves and the liquid flush valve while receiving and using the primary flow signal as flow information feedback.

In one embodiment, the flow indicator is a high speed, positive displacement volumetric flow indicator. In another embodiment, wherein the primary pump is a positive displacement pump, the flow indicator is a counter device adapted to count pump displacements so as to thereby allow a calculation of flow through the operating pump.

Also, it is preferred that the computer be programmed to control the dispensing system without input as to the flow of any liquid stream upstream of the operating pump.

In a typical system, the controller is programmed to control the dispensing system in accordance with operating instructions to dispense a designated volume of a desired chemical stored in a designated chemical storage vessel to a designated receptacle by causing the following steps to occur:

(a) opening the inlet valve on the inlet conduit attached in fluid tight communication with the designated chemical storage vessel and opening the dispensing valve on the dispensing conduit attached in fluid tight communication with the designated receptacle;

(b) thereafter engaging the operating pump to pump liquid into the designated receptacle while drawing the designated volume of the desired chemical from the designated storage vessel into the suction conduit;

(c) thereafter, when a volume of liquid equal to the designated volume is indicated to have been pumped through the flow indicator, closing the inlet valve on the inlet conduit attached in fluid tight communication with the designated chemical storage vessel;

(d) thereafter opening the liquid flush valve and allowing sufficient liquid from the source of pressurized liquid to flow into the suction and discharge conduits to flush all of the desired liquid chemical into the designated receptacle; and (e) thereafter shutting down the operating pump, closing the liquid flush valve and closing the dispensing valve on the dispensing conduit attached in fluid tight communication with the designated receptacle.

In a preferred embodiment, the system further comprises:

(a) a gas flush conduit having an upstream end and a downstream end, the upstream end being connected in fluid tight communication with a source of pressurized gas and the downstream end being connected in fluid tight communication with the dispensing conduit at a connection location upstream of the dispensing conduits and downstream of the flow indicator; and (b) a remote controllable gas flush valve operatively disposed within the gas flush conduit for controlling gaseous flow therein.

In such a preferred system, the controller is programmed to control the dispensing system in accordance with instructions to dispense a designated volume of a desired chemical stored in a designated chemical storage vessel to a designated receptacle by causing the following steps to occur:

(a) opening the inlet valve on the inlet conduit attached in fluid tight communication with the designated chemical storage vessel and opening the dispensing valve on the dispensing conduit attached in fluid tight communication with the designated receptacle;

(b) thereafter engaging the operating pump to pump liquid into the designated receptacle while drawing the designated volume of the desired chemical from the designated storage vessel into the suction conduit;

(c) thereafter, when a volume of liquid equal to the designated volume is indicated to have been pumped through the flow indicator, closing the inlet valve on the inlet conduit attached in fluid tight communication with the designated chemical storage vessel;

(d) thereafter opening the liquid flush valve and allowing sufficient liquid from the source of pressurized liquid to flow into the suction and discharge conduits to flush all of the desired liquid chemical past the connection location of the gas flush conduit;

(e) thereafter shutting down the operating pump and closing the liquid flush valve;

(f) thereafter opening the gas flush valve and allowing sufficient gas from the source of pressurized gas to flow into the discharge conduit and the dispensing conduit attached in fluid tight communication with the designated receptacle to flush all of the desired liquid chemical within the discharge conduit and the dispensing conduit attached in fluid tight communication with the designated receptacle into the designated receptacle; and (g) thereafter closing the gas flush valve and closing the dispensing valve on the dispensing conduit attached in fluid tight communication with the designated receptacle.

It is preferable that the controller be programmed such that, if the controller receives a second operating instruction before the dispensing system has fully satisfied a first operating instruction, the controller retains the second operating instruction in memory and controls the dispensing system in accordance with the second operating instruction only after the dispensing system has fully satisfied the first operating instruction.

In still another preferred embodiment, the operating pump is an air-driven diaphragm pump and the controller monitors driving air flowing to the pump to thereby calculate the flow of liquids pumped by the operating system. Such a calculation acts as a back-up check on the flow indicator.

As a further check on the system, flow switches which generate an on/off signal to the controller can be operatively disposed within the liquid flush conduit, the discharge conduit and/or the gas flush conduit to confirm flow conditions of fluid therethrough.

The invention is ideal for use in the laundry and textile industries, as well for use in the food processing, plating, electronics and pharmaceutical industries. However, the system can be easily adapted to virtually any industry where automated chemical dispensing is advantageous or required.

DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
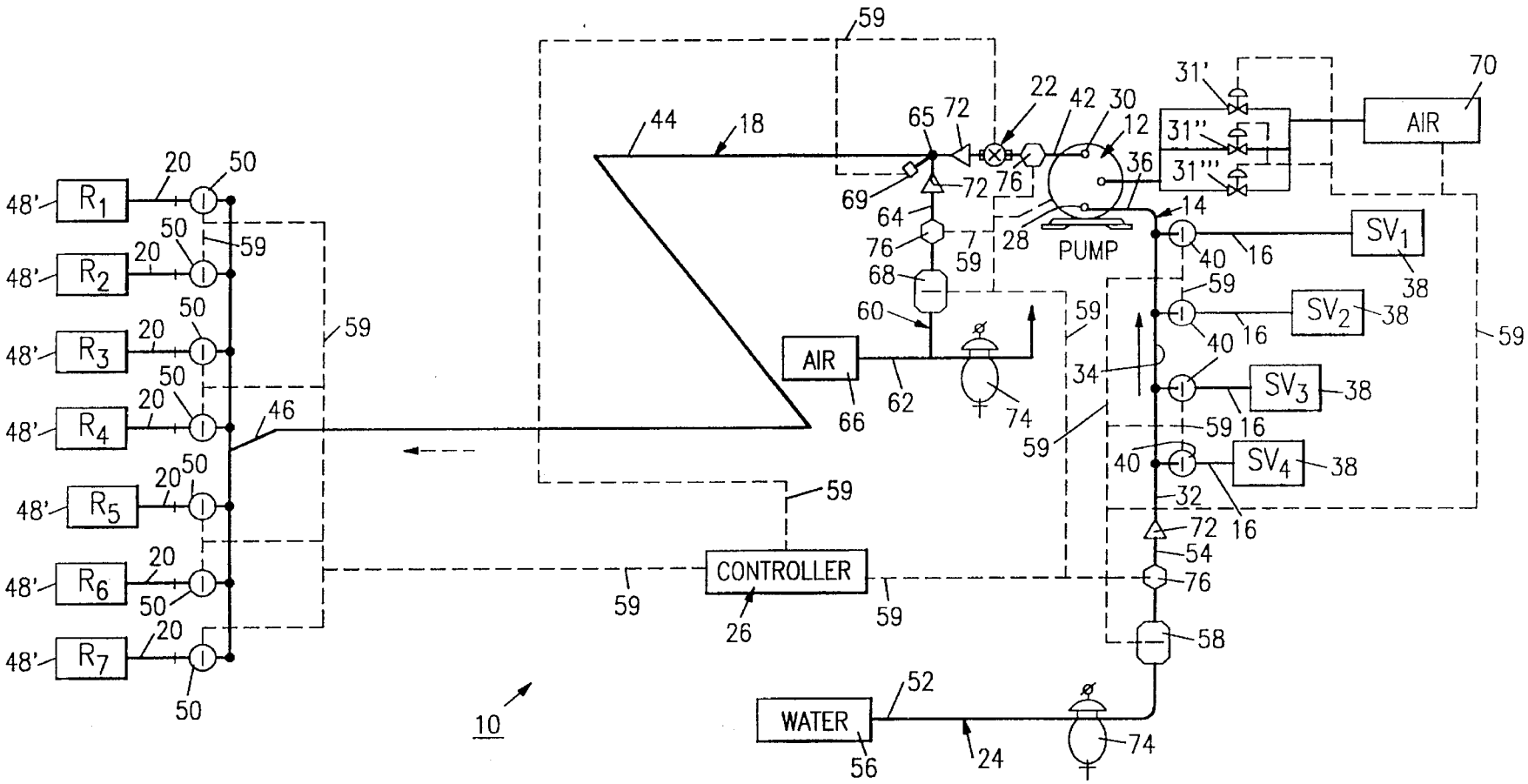
FIG. 1 is a flow diagram showing a first typical apparatus system of the invention, including the use of flushing gas which is injected proximate to the flow indicator.

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention is a method and an apparatus system for quickly and reliably dispensing a preselected quantity of liquid chemical drawn from one or more of a plurality of storage vessels and dispensing that quantity of liquid chemical to one of a plurality of receptacles using a single operating pump. Referring now to the drawings, the dispensing system of the invention 10 comprises an operating pump 12, a suction conduit 14, a plurality of inlet conduits 16, a discharge conduit 18, a plurality of dispensing conduits 20, a flow indicator 22, a liquid flush conduit 24 and a computerized controller 26.

The operating pump 12 has a suction side 28 and a discharge side 30 and is remote controllable by the controller 26. It is preferable that the pumping capacity of the operating pump 12 can be varied between about 18 liquid ounces per minute and about 30 gallons per minute.

Preferably, the operating pump 12 is an air driven diaphragm pump. Where the operating pump 12 is an air-driven pump, the pumping "power" and speed of the operating pump 12 can be conveniently varied by routing driving air to the operating pump 12 through one of several separate pressure control valves 31, e.g., a high pressure control valve 31', a medium pressure control valve 31" and a low pressure control valve 31'", as shown in FIG. 1. Thus, where the controller 26 senses that "power" and/or speed is required by the operating pump 12, the controller 26 would engage the operating pump 12 through the high pressure control valve 31' on the driving air system 70 (described below). On the other hand, where the controller senses that lower "power" and/or lower speed is required by the operating pump 12, the controller 26 can operate the operating pump 12 using one of the lower pressure air controllers 31" or 31'" on the driving air system 70.

The operating pump 12 can be one of many different types. In a preferred embodiment, the operating pump 12 is a self-priming positive displacement pump, such an air or motor operated diaphragm, tube-type peristaltic or gear pump.

Optionally, a back-up pump (not shown) can be installed in parallel with the operating pump 12. The back-up pump is generally used only when the operating pump 12 is not functional. In a preferred embodiment, the back-up pump is designed to automatically activated whenever the operating pump malfunctions or fails. This can be accomplished by manifolding the stand-by pump in parallel with the operating pump 12 using automatically activated control valves in the manifold (not shown).

The suction conduit 14 has an upstream end 32, a midsection 34 and a downstream end 36. The downstream end 36 is disposed in fluid tight communication with the suction side 28 of the operating pump 12. The cross-sectional area of the suction conduit 14 is chosen to balance pressure drop requirements and operating cost factors against capital cost factors. The cross-sectional diameter of the suction conduit 14 is generally chosen small enough to minimize mixing within the suction conduit 14.

Each inlet conduit 16 is adapted to receive a quantity of liquid chemical from one of the plurality of storage vessels 38 and to discharge such quantity of liquid chemical to the midsection 34 of the suction conduit 14. Disposed within each inlet conduit 16 is a remote controllable inlet valve 40 for controlling liquid flow within the inlet conduit 16. In a typical embodiment, the inlet valves 40 are solenoid ball valves and serve only an on/off function as opposed to a metering function.

Where one or more storage vessels 38 are disposed at some distance from the operating pump 12, a separate delivery pump (not shown) can be disposed within the inlet conduit 16 for such storage vessel 38 to keep the inlet conduit 16 primed and to reduce the suction head requirements of the operating pump 12.

The discharge conduit 18 has an upstream end 42, a midsection 44 and a downstream end 46. The upstream end 42 is disposed in fluid tight communication with the discharged side 30 of the operating pump 12. As is the case with the suction conduit 14, the cross-sectional area of the discharge conduit 18 is generally chosen small enough to minimize mixing within the discharge conduit 18.

Each dispensing conduit 20 is disposed in fluid tight communication with the downstream end 46 of the discharge conduit 18, and is adapted to receive a quantity of liquid chemical from the downstream end 46 of the discharge conduit 18 and to discharge such quantity of liquid chemical to one of the plurality of receptacles 48. Disposed within each dispensing conduit 20 is a remote controllably dispensing valve 50, operatively disposed within the dispensing conduit 20 for controlling liquid flow therein. As is the case with the inlet valves 40, the dispensing valves 50 are typically solenoid ball valves and serve only an on/off function, as opposed to a metering function.

The flow indicator 22 is operatively disposed within the upstream end 42 of the discharge conduit 18 for monitoring liquid flow therein. The flow indicator 22 generates a primary flow signal which is transmitted to the controller 26. From the primary flow signal, the controller 26 can calculate the flow of fluids through the flow indicator 22 and control the rest of the dispensing system 10 accordingly. It is preferable that the flow indicator 22 can accurately measure flows between about 18 liquid ounces per minute and about 30 gallons per minute.

In one preferred embodiment, the flow indicator 22 is a high speed, positive displacement volumetric flow measuring device, capable of accurately measuring the flow of many different liquids having different specific gravities and different viscosities.

Figure 4:
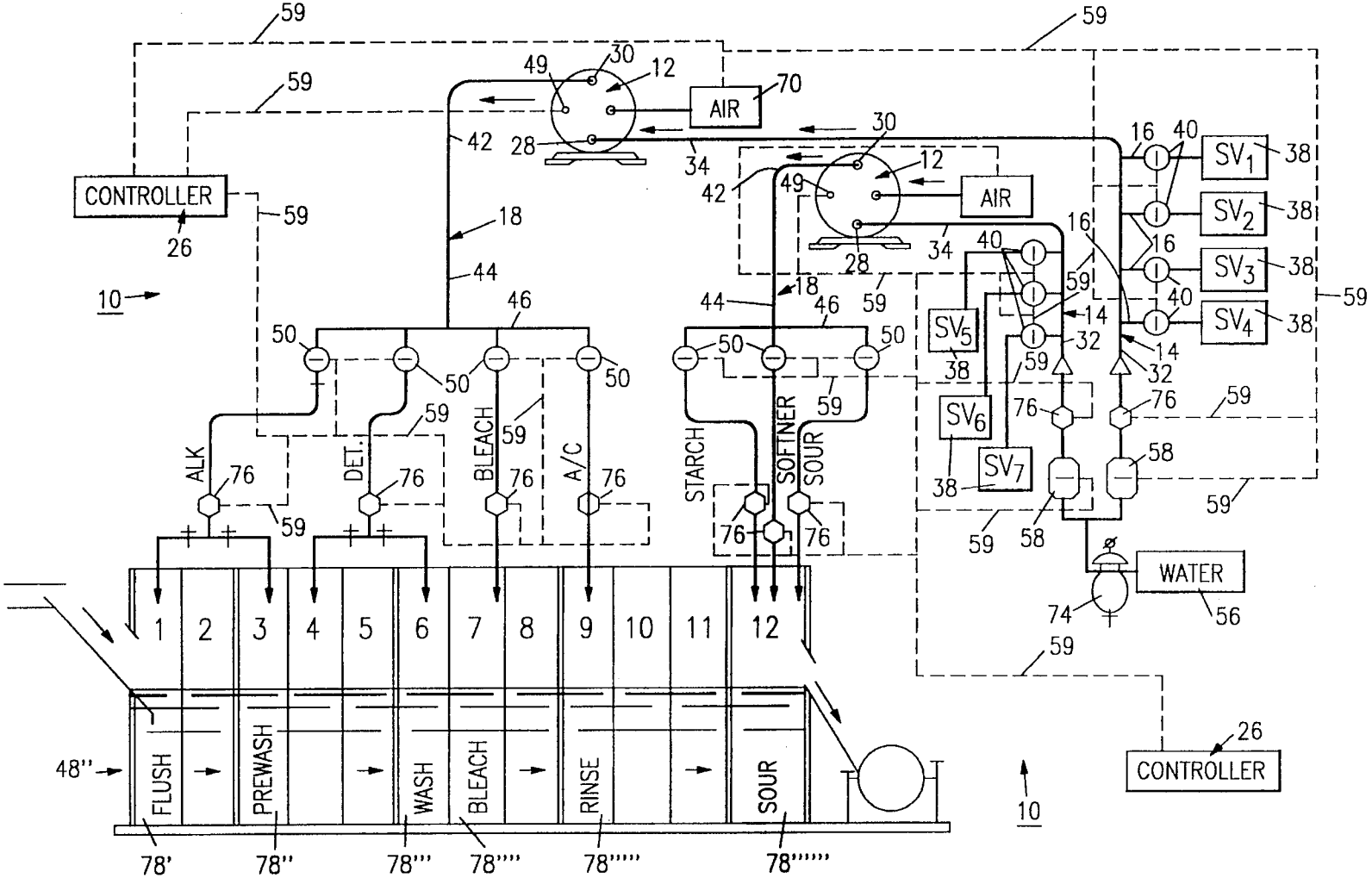
FIG. 4 is a flow diagram showing two typical embodiments of the invention combined to service a continuous tunnel washer, neither embodiment using flushing gas.

In another preferred embodiment, where the operating pump 12 is a positive displacement pump, the flow indicator 22 can be a counter device 49 adapted to count operating pump 12 displacements, and from such pump displacements, allow a calculation of flow through the operating pump 12. This embodiment is shown in FIG. 4. For example, where a peristaltic pump is employed as the operating pump 12, a pulsating stroke counter 49 can be employed to count the rotation of the peristaltic pump roller using an attached microswitch or magnetic sensor (not shown). Each time the roller passes or makes contact with the switch, it sends a signal to the controller 26 which calculates the actual volume flow through the operating pump 12. Alternatively, the counter device 49 can measure the rotation of the operating pump 12 or pump motor.

The liquid flush conduit 24 has an upstream end 52 and a downstream end 54. The upstream end 52 is connected in fluid tight communication with a source of pressurized liquid 56, and the downstream end is connected in fluid tight communication with the upstream end 32 of the suction conduit 14. In an a typical installation, the flush liquid is water and the source of pressurized liquid 56 is a tap water connection or a water source pressurized by a water pump (not shown).

Disposed within the liquid flush conduit 24 is a remote controllable liquid flush valve 58 operatively disposed within the liquid flush conduit 24 for controlling liquid flow therein. Like the inlet valves 40 and the dispensing valves 50, in a typical embodiment, the liquid flush valve 58 is a solenoid valve and serves merely an on/off function, as opposed to a metering function.

The controller 26 is typically a computer programmed to (i) receive operating instructions regarding the transferring of a quantity of chemical from one of the storage vessels 38 to one of the receptacles 48, and (ii) control the rest of the dispensing system 10 in accordance with the operating instructions by operating the inlet valves 40, the operating pump 12, the dispensing valves 50 and the liquid flush valve 58 while receiving and using the primary flow signal as flow information feedback. The controller 26 sends and receives signals to the rest of the dispensing system 10 via any of the many signal hardware systems 59 known to the art. In the drawings, such signal hardware 59 is indicated generally by dashed lines running to and from the controller 26.

In a typical installation, the controller 26 is programmed to control the rest of the dispensing system 10 by feedback provided from the primary flow signal alone. No flow input is used by the controller 26 regarding the flow of any liquid stream upstream of the operating pump 12. The ability to control the system using feedback from the primary flow signal alone provides a significant capital, maintenance and operating cost savings to the user.

Typically, the controller 26 is specifically programmed to control the rest of the dispensing system 10 in accordance with operating instructions to dispense a designated volume of a desired chemical stored in one of the designated chemical storage vessels 38 to one of the designated receptacles 48 by causing the following steps to occur:

(a) opening the inlet valve 40 on the inlet conduit 16 attached in fluid tight communication with the designated chemical storage vessel 38 and opening the dispensing valve 50 on the dispensing conduit 20 attached in fluid tight communication with the designated receptacle 48;

(b) thereafter engaging the operating pump 12 to pump liquid into the designated receptacle 48 while drawing the designated volume of the desired chemical from the designated storage vessel 38 into the suction conduit 14;

(c) thereafter, when a volume of liquid equal to the designated volume is indicated to have been pumped through the flow indicator 22, closing the inlet valve 40 on the inlet conduit 16 attached in fluid tight communication with the designated chemical storage vessel 38;

(d) thereafter opening the liquid flush valve 58 and allowing sufficient liquid from the source of pressurized liquid 56 to flow into the suction and discharge conduits 14 and 18 to flush all of the desired liquid chemical into the designated receptacle 48; and (e) thereafter shutting down the operating pump 12, closing the liquid flush valve 58 and closing the dispensing valve 50 on the dispensing conduit 20 attached in fluid tight communication with the designated receptacle 48.

In a preferred embodiment, the controller 26 software program is designed to interface with a computer monitor and/or printing equipment (not shown) to provide a graphical display and/or hard records of system operation.

In another preferred embodiment, the dispensing system 10 further comprises a gas flush conduit 60 having an upstream end 62 and a downstream end 64. The upstream end 62 is connected in fluid tight communication with a source of pressurized gas 66 and the downstream end 64 is connected in fluid tight communication with the discharge conduit 18 at a connection location 65 upstream of the dispensing conduits 20 and downstream of the flow indicator 22. In a typical embodiment, the flush gas is pressurized air.

Within the gas flush conduit 60 is disposed a remote controllable gas flush valve 68 operatively disposed within the gas flush conduit 60 for controlling gaseous flow therein. As is the case with the inlet valves 40, the dispensing valves 50 and the liquid flush valve 58, the gas flush valve 68 is typically a solenoid valve and serves merely an on/off function, as opposed to a metering function.

In order to determine how long to keep the gas flush flowing, the invention 10 can incorporate a pressure transducer or pressure switch 69 to measure the pressure within gas flush conduit 62 at the connection location 65 with the discharge conduit 18. When the discharge conduit 18 is filled with liquid, the pressure at the connection location 65 will be much higher than when the discharge conduit 18 contains only gas. Accordingly, the controller 26 monitors the pressure at the connection location 65 and closes the gas flush valve 68 when the pressure at that location suddenly drops.

Figure 2:
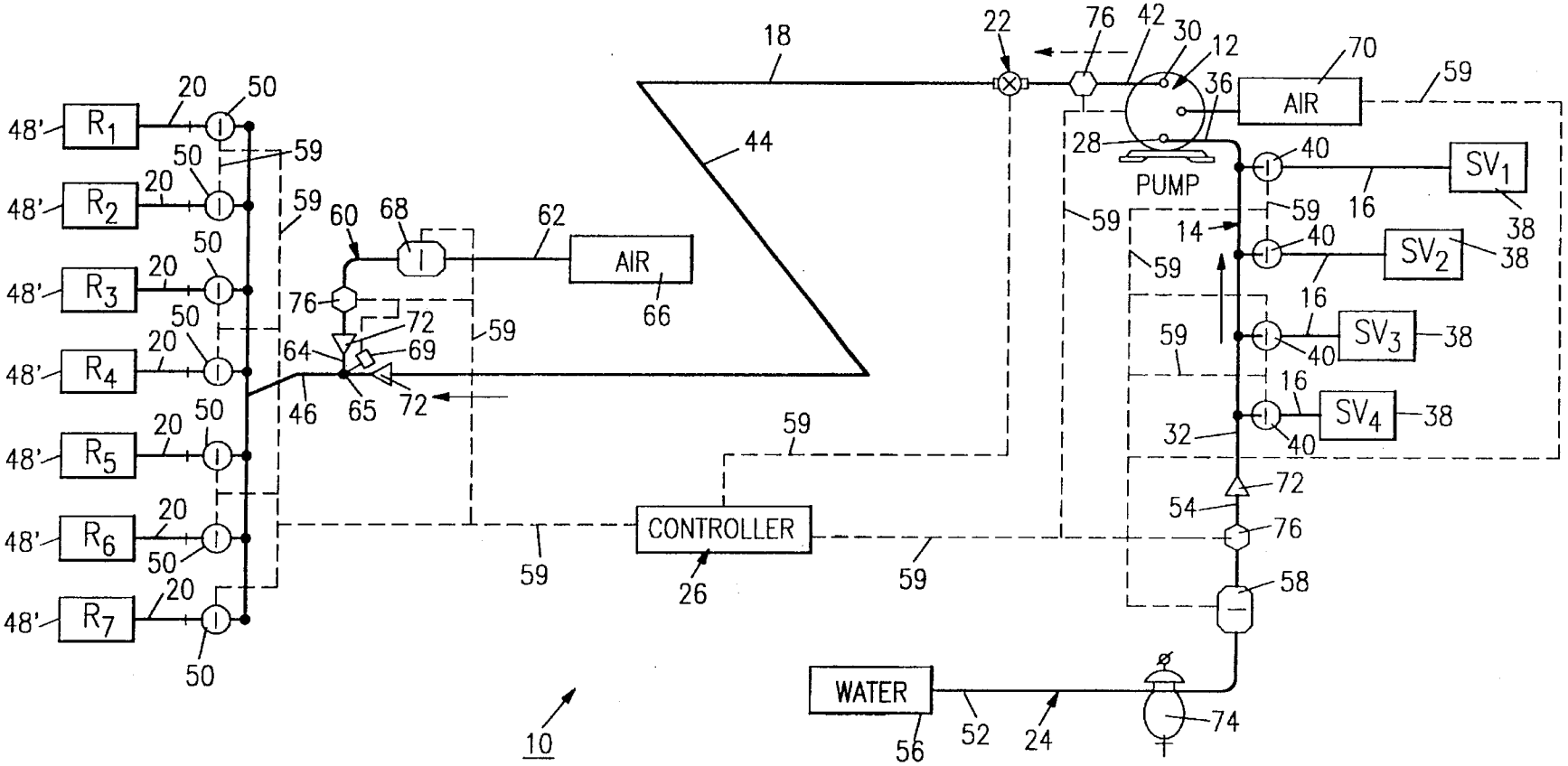
FIG. 2 is a flow diagram showing a second typical apparatus system of the invention, including the use of a flushing gas which is injected proximate to the dispensing conduits.

FIGS. 1 and 2 show such a preferred embodiment. FIG. 1 illustrates an embodiment wherein the flushing gas injection is made proximate to the flow indicator 22. FIG. 2 illustrates an embodiment wherein the flushing gas injection is made proximate to the dispensing conduits 20.

In the above-described preferred dispensing system 10 having a gas flush conduit 62, the controller 26 is typically programmed to control the rest of the dispensing system 10 in accordance with operating instructions to dispense a designated volume of a desired chemical stored within one of the designated chemical storage vessels 38 to one of the designated receptacles 48 by causing the following steps to occur:

(a) opening the inlet valve 40 on the inlet conduit 16 attached in fluid tight communication with the designated chemical storage vessel 38 and opening the dispensing valve 50 on the dispensing conduit 20 attached in fluid tight communication with the designated receptacle 48;

(b) thereafter engaging the operating pump 12 to pump liquid into the designated receptacle 48 while drawing the designated volume of the desired chemical from the designated storage vessel 38 into the suction conduit 14;

(c) thereafter, when a volume of liquid equal to the designated volume is indicated to have been pumped through the flow indicator 22, closing the inlet valve 40 on the inlet conduit 16 attached in fluid tight communication with the designated chemical storage vessel 38;

(d) thereafter opening the liquid flush valve 58 and allowing sufficient liquid from the source of pressurized liquid 56 to flow into the suction and discharge conduits 14 and 18 to flush all of the desired liquid chemical past the connection location 65 of the gas flush conduit 60;

(e) thereafter shutting down the operating pump 12 and closing the liquid flush valve 58;

(f) thereafter opening the gas flush valve 68 and allowing sufficient gas from the source of pressurized gas 66 to flow into the discharge conduit 60 and the dispensing conduit 20 attached in fluid tight communication with the designated receptacle 48 to flush all of the liquid within the discharge conduit 18 and the dispensing conduit 20 attached in fluid tight communication with the designated receptacle 48 into the designated receptacle 48; and (g) thereafter closing the gas flush valve 68 and closing the dispensing valve 50 on the dispensing conduit 20 attached in fluid tight communication with the designated receptacle 48.

The major advantages of gas flush are: (a) gas flush speeds up the delivery of liquids to the receptacles 48; and gas flush reduces the amount of liquid flush (thereby decreasing the amount of liquid flush within the receptacle 48). Excess flush liquid within the receptacles 48 requires increased chemical within that receptacle 48 to maintain proper chemical concentration. Accordingly, the use of gas flush reduces the cost of both liquid flush and chemical, while substantially speeding up the system.

In the preferred embodiment described above wherein the operating pump 12 is air driven, the flow of driving air 70 to the operating pump 12 is monitored by the controller 26 to calculate the amount of liquid being pumped by the operating pump 12 to the discharge conduit 18. Such monitoring of the driving air 70 to the operating pump 12 provides a convenient back-up check against the primary signal generated by the flow indicator 22.

Preferably, the controller 26 is also programmed so that, if the controller 26 receives a second operating instruction before the rest of the dispensing system 10 has fully satisfied a first operating instruction, the controller 26 retains the second operating instruction in memory and controls the rest of the dispensing system 10 in accordance with the second operating instruction only after the rest of the dispensing system 10 has fully satisfied the first operating instruction.

As shown in the drawings, the dispensing system 10 can further comprise various other components. For example, check valves 72 can be disposed within the various conduits at appropriate locations to prevent the flow of fluids in an undesired direction. Also, pressure regulators 74 can be installed in the liquid flush conduit 24 and/or gas flush conduits 60. Also, flow switches 76, which detect the flow of fluids, can be employed within any of the several conduits. Preferably, such flow switches 76 generate individual signals to the controller 26 to allow the controller 26 to monitor the operation of the rest of the dispensing system 10.

The invention 10 can further comprise various alarm and other self-diagnostic features (not shown) to check and double-check the continuing good functionality of the system.

Figure 3:
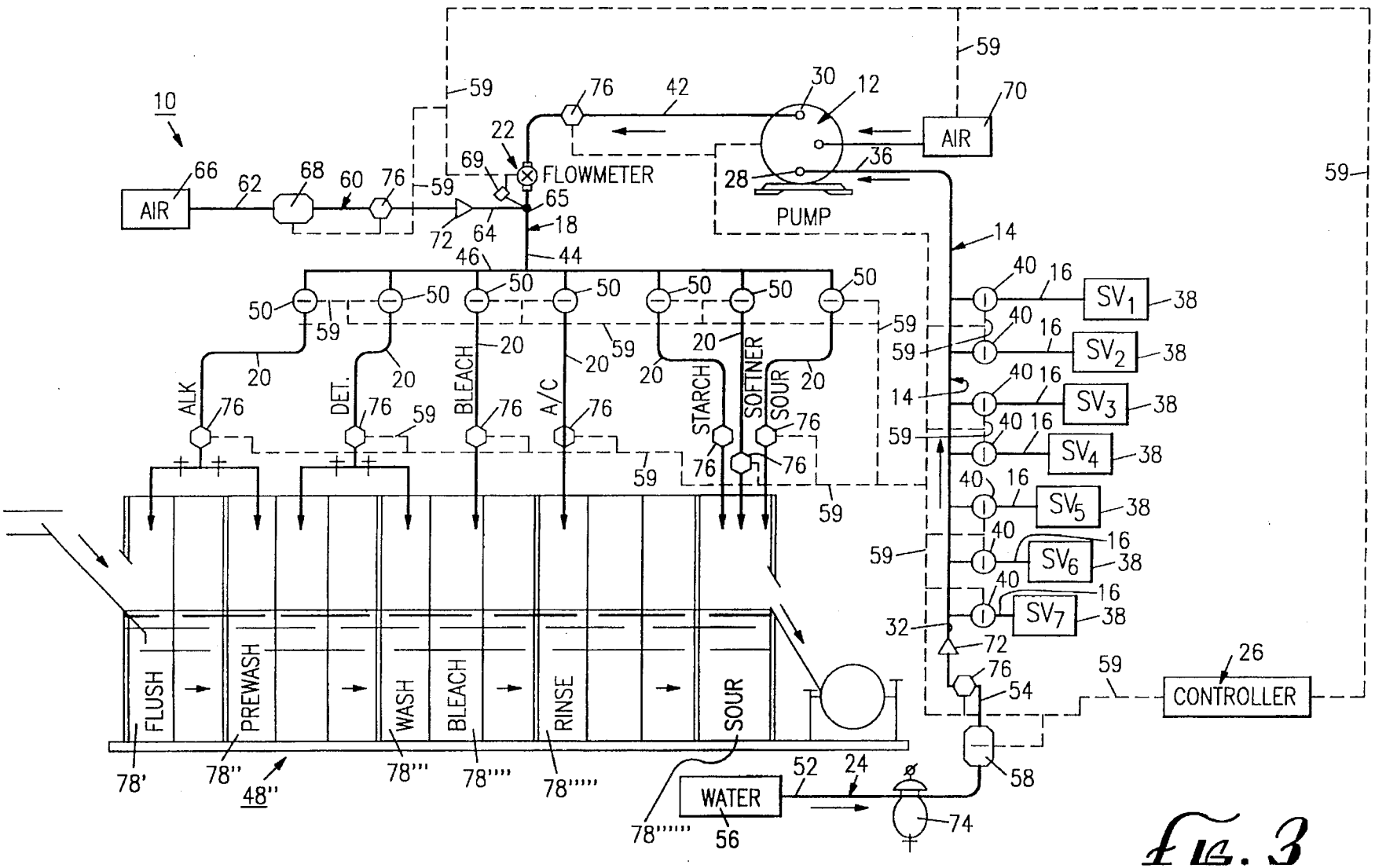
FIG. 3 is a flow diagram showing a third typical apparatus system of the invention in use within a continuous tunnel washer, including the use of flushing gas.

The drawings illustrate typical embodiment of the invention 10 as they are used to service two different types of industrial laundry machines 48. FIGS. 1 and 2 illustrate the invention 10 servicing batch washing machines 48' and FIGS. 3 and 4 illustrate embodiments of the invention servicing continuous process machines 48" (commonly called "tunnel washers").

Batch washing machines 48' are discreet machines designed to process a certain size or volume of goods over a certain period of time. Batch washing machines 48' require that all washing chemical be injected into the same machine 48' at different stages of the cleaning process. Typically, each stage of the cleaning process generally requires the filling of the machine 48' with water, the raising of the water to operating temperature, the receipt of laundry chemicals, the subsequent draining of the aqueous chemical solution and a rinse cycle. Each batch washer 48' needs only one dispensing conduit 20.

Contrasted with batch washing machines 48' are continuous process washing machines 48". In a continuous process washing machine 48", each machine 48" consists of several functioning compartments 78. The clothes or other items to be washed are physically moved from compartment 78 to compartment 78 during the washing cycle. Each compartment 78 may require its own laundry chemicals. Each compartment 78 has its own dispensing conduit 20. A typical continuous process washing machine 48" comprises a flush compartment 78', a pre-wash compartment 78", a wash compartment 78''', a bleach compartment 78'''', a rinse compartment 78''''' and a sour compartment 78''''''. Each compartment 78 typically has a cycle time between about 90 second and about 5 minutes. The relatively short cycle time within each compartment 78 requires rapid injection of chemicals. Thus, it can be seen that servicing a large number of continuous process washing machines 48", wherein each washing machine 48" has a plurality of compartments 78 which continuously require differing amounts of different laundering chemicals, requires an exceptionally rapid and accurate dispensing system. The dispensing system of the invention 10 is ideally suited for such demanding requirements.

A unique difference between batch washing machine systems and continuous process washing machine systems is the sequence of injections. For batch washers 48', injection is performed by first pumping chemical alkali, then detergent, then bleach anti-chlor, sour, softener, starch, etc. In continuous process washing machines 48", the injection sequence starts from the rear-end of the washer 48". The last compartment 78 receives sour, softener, starch, followed by anti-chlor, bleach, detergent and alkali.

Regardless of the type of laundry machines 48 serviced, in a typical laundry operation, a washing machine 48 sends a request for a particular chemical to the controller 26. The controller 26 recognizes the required chemical type and opens the inlet valve 40 on the inlet line 16 to the storage vessel 38 housing the requested chemical. The controller 26 also opens the dispensing valve 50 on the dispensing line 20 to the washing machine 48 requesting the chemical and turns on the operating pump 12. When the operating pump 12 is turned on, the chemical is pumped from the storage vessel 38 and into the discharge conduit 18. The controller 26 monitors the flow of chemical as it passes through the flow indicator 22. Once the requested volume of chemical passes through the flow indicator 22, the controller 26 closes the inlet valve 40 and opens the liquid flush valve 58. When the liquid flush valve 58 is open, water within the liquid flush conduit 24 flushes the chemical out of the discharge conduit 18 and into the washing machine 48.

If the controller 26 receives more than one chemical request from a machine 48, the controller 26 will either water flush the then-present chemical from the discharge conduit 18 in full or, alternatively, cause a short water flush, close the liquid flush valve 58 and open the air flush valve 68. Opening the air flush valve 68 causes air to blow down the remaining liquid to the washer 48.

To speed up system injection, if there are several chemical requests from a single washer 48, the controller 26 can be programmed to inject a water flush for a few seconds in between the flow of requested chemical and, when there is no further request for chemicals to that particular washing machine 48, initiate a full flush and air blow down. Utilizing the system in this way decreases dispensing time by as much as 50%.

If there are two or more washing machines 48 requesting chemicals at the same time, the controller 26 keeps the second request in memory, executes the first request and then executes the second request. The operation of the washing machine 48 sending the second request (the request placed into memory by the controller 26) is suspended during the period of time that the first request is satisfied. When the controller 26 turns its attention to the second request, the operation of the machine 48 making that request is reinstated.

The invention 10 is ideal for use in many industries, including the laundry, textile, food processing, plating, electronic and pharmaceutical industries. A typical commercial embodiment can easily dispense over 40 different chemicals to as many as 20 or more receptacles 48. The system 10 avoids the inaccuracies, delays and costs of dilution manifolds. The invention 10 also avoids the inaccuracy, cost and inflexibility of flow orifices.

Because the invention only requires a single operating pump 12, the user is provided significant savings in capital, operating and maintenance costs.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A chemical dispensing system for dispensing a preselected quantity of liquid chemical drawn from one of a plurality of storage vessels and dispensing that quantity of liquid chemical to one of a plurality of receptacles using a single operating pump, the dispensing system comprising:

(a) a remote controllable operating pump having a suction side and a discharge side;

(b) a suction conduit having an upstream end, a midsection and a downstream end, the downstream end being in fluid tight communication with the suction side of the operating pump;

(c) a plurality of inlet conduits, each inlet conduit being adapted to receive a quantity of liquid chemical from one of the plurality of storage vessels and to discharge such quantity of liquid chemical to the midsection of the suction conduit;

(d) a plurality of remote controllable inlet valves, one inlet valve being operatively disposed within each inlet conduit for controlling liquid flow therein;

(e) a discharge conduit having an upstream end, a midsection and a downstream end, the upstream end being in fluid tight communication with the discharge side of the operating pump;

(f) a plurality of dispensing conduits, each dispensing conduit being adapted to receive a quantity of liquid chemical from the downstream end of the discharge conduit and to discharge such quantity of liquid chemical to one of the plurality of receptacles;

(g) a plurality of remote controllable dispensing valves, one dispensing valve being operatively disposed within each dispensing conduit for controlling liquid flow therein;

(h) a flow indicator operatively disposed within the upstream end of the discharge conduit for monitoring liquid flow therein, and generating a primary flow signal corresponding thereto;

(i) a liquid flush conduit having an upstream end and a downstream end, the upstream end being connected in fluid tight communication with a source of pressurized liquid and the downstream end being connected in fluid tight communication with the upstream end of the suction conduit;

(j) a remote controllable liquid flush valve operatively disposed within the liquid flush conduit for controlling liquid flow therein;

(k) a computerized controller programmed to (i) receive operating instructions regarding the transferring of a quantity of chemical from one of the storage vessels to one of the receptacles and to (ii) control the dispensing system in accordance with the operating instructions by operating the inlet valves, the operating pump, the dispensing valves and the liquid flush valve while receiving and using the primary flow signal as flow information feedback.

2. The dispensing system of claim 1 wherein the computerized controller is programmed to control the dispensing system without input as to the flow of any liquid stream upstream of the pump.

3. The dispensing system of claim 1 wherein the source of pressurized liquid is a source of pressurized water.

4. The dispensing system of claim 1 wherein the computerized controller is programmed to control the dispensing system in accordance with operating instructions to dispense a designated volume of a desired chemical stored in a designated chemical storage vessel to a designated receptacle by causing the following steps to occur:

(a) opening the inlet valve on the inlet conduit attached in fluid tight communication with the designated chemical storage vessel and opening the dispensing valve on the dispensing conduit attached in fluid tight communication with the designated receptacle;

(b) thereafter, engaging the operating pump to pump liquid into the designated receptacle while drawing the designated volume of the desired chemical from the designated storage vessel into the suction conduit;

(c) thereafter, when a volume of liquid equal to the designated volume is indicated to have been pumped through the flow indicator, closing the inlet valve on the inlet conduit attached in fluid tight communication with the designated chemical storage vessel;

(d) thereafter, opening the liquid flush valve and allowing sufficient liquid from the source of pressurized liquid to flow into the suction and discharge conduits to flush all of the desired liquid chemical into the designated receptacle; and (e) thereafter, shutting down the operating pump, closing the liquid flush valve and closing the dispensing valve on the dispensing conduit attached in fluid tight communication with the designated receptacle.

5. The dispensing system of claim 1 further comprising:

(a) a gas flush conduit having an upstream end and a downstream end, the upstream end being connected in fluid tight communication with a source of pressurized gas and the downstream end being connected in fluid tight communication with the dispensing conduit at a connection location upstream of the dispensing conduits and downstream of the flow indicator; and (b) a remote controllable gas flush valve operatively disposed within the gas flush conduit for controlling gaseous flow therein.

6. The dispensing system of claim 5 wherein the source of pressurized gas is a source of pressurized air.

7. The dispensing system of claim 5 wherein the computerized controller is programmed to control the dispensing system in accordance with operating instructions to dispense a designated volume of a desired chemical stored in a designated chemical storage vessel to a designated receptacle by causing the following steps to occur:

(a) opening the inlet valve on the inlet conduit attached in fluid tight communication with the designated chemical storage vessel and opening the dispensing valve on the dispensing conduit attached in fluid tight communication with the designated receptacle;

(b) thereafter, engaging the operating pump to pump liquid into the designated receptacle while drawing the designated volume of the desired chemical from the designated storage vessel into the suction conduit;

(c) thereafter, when a volume of liquid equal to the designated volume is indicated to have been pumped through the flow indicator, closing the inlet valve on the inlet conduit attached in fluid tight communication with the designated chemical storage vessel;

(d) thereafter, opening the liquid flush valve and allowing sufficient liquid from the source of pressurized liquid to flow into the suction and discharge conduits to flush all of the desired liquid chemical past the gas flush conduit connection location;

(e) thereafter, shutting down the operating pump and closing the liquid flush valve;

(f) thereafter, opening the gas flush valve and allowing sufficient gas from the source of pressurized gas to flow into the discharge conduit and the dispensing conduit attached in fluid tight communication with the designated receptacle to flush all of the liquid within the discharge conduit and the dispensing conduit attached in fluid tight communication with the designated receptacle into the designated receptacle; and (g) thereafter, closing the gas flush valve and closing the dispensing valve on the dispensing conduit attached in fluid tight communication with the designated receptacle.

8. The dispensing system of claim 7 wherein, if the computerized controller receives a second operating instruction before the dispensing system has fully satisfied a first operating instruction, the computerized controller retains the second operating instruction in memory and controls the dispensing system in accordance with the second operating instruction only after the dispensing system has fully satisfied the first operating instruction.

9. The dispensing system of claim 1 wherein the operating pump is an air-driven pump.

10. The dispensing system of claim 9 wherein the operating pump is driven by air delivered through one of a plurality of air control valves, each of the control valves being set to deliver air at differing downstream pressures.

11. The dispensing system of claim 9 wherein the computerized controller monitors air flowing to the air-driven operating pump to calculate the flow of liquids pumped by the operating pump.

12. The dispensing system of claim 1 wherein the pumping capacity of the operating pump can be varied between about 18 liquid ounces per minute and about 30 gallons per minute.

13. The dispensing system of claim 1 wherein the flow indicator is a positive displacement volumetric flow indicator which measures the flow of liquids directly.

14. The dispensing system of claim 1 wherein the operating pump is a positive displacement pump and wherein the flow indicator is a counter device adapted to count pump displacements.

15. The dispensing system of claim 4 wherein a flow switch is operatively disposed within the liquid flush conduit, the discharge conduit and the gas flush conduit to monitor the flow of fluids therethrough.

16. A chemical dispensing system for dispensing a preselected quantity of liquid chemical drawn from one of a plurality of storage vessels and dispensing that quantity of liquid chemical to one of a plurality of receptacles using a single operating pump, the dispensing system comprising:

(a) a remote controllable operating pump having a suction side and a discharge side;

(b) a suction conduit having an upstream end, a midsection and a downstream end, the downstream end being in fluid tight communication with the suction side of the operating pump;

(c) a plurality of inlet conduits, each inlet conduit being adapted to receive a quantity of liquid chemical from one of the plurality of storage vessels and discharge such quantity of liquid chemical to the midsection of the suction conduit;

(d) a plurality of remote controllable inlet valves, one inlet valve being operatively disposed within each inlet conduit for controlling liquid flow therein;

(e) a discharge conduit having an upstream end, a midsection and a downstream end, the upstream end being in fluid tight communication with the discharge side of the operating pump;

(f) a plurality of dispensing conduits, each dispensing conduit being adapted to receive a quantity of liquid chemical from the downstream end of the discharge conduit and discharge such quantity of liquid chemical to one of the plurality of receptacles;

(g) a plurality of remote controllable dispensing valves, one dispensing valve being operatively disposed within each dispensing conduit for controlling liquid flow therein;

(h) a flow indicator operatively disposed within the upstream end of the discharge conduit for monitoring liquid flow therein, and generating a flow signal corresponding thereto;

(i) a liquid flush conduit having an upstream end and a downstream end, the upstream end being connected in fluid tight communication with a source of pressurized liquid and the downstream end being connected in fluid tight communication with the upstream end of the suction conduit;

(j) a remote controllable liquid flush valve operatively disposed within the liquid flush conduit for controlling liquid flow therein;

(k) a computerized controller programmed to (i) receive operating instructions regarding the transferring of a quantity of chemical from one of the storage vessels to one of the receptacles and to (ii) control the dispensing system in accordance with the operating instructions by operating the inlet valves, the pump, the dispensing valves and the liquid flush valve while receiving and using the flow signal as flow information feedback;

(l) a gas flush conduit having an upstream end and a downstream end, the upstream end being connected in fluid tight communication with a source of pressurized gas and the downstream end being connected in fluid tight communication with the midsection of the dispensing conduit at a connection location upstream of the dispensing conduits and downstream of the flow indicator; and (m) a remote controllable gas flush valve operatively disposed within the gas flush conduit for controlling gaseous flow therein.

17. The dispensing system of claim 16 wherein the computerized controller is programmed to control the dispensing system in accordance with operating instructions to dispense a designated volume of a desired chemical stored in a designated chemical storage vessel to a designated receptacle by causing the following steps to occur:

(a) opening the inlet valve on the inlet conduit attached in fluid tight communication with the designated chemical storage vessel and opening the dispensing valve on the dispensing conduit attached in fluid tight communication with the designated receptacle;

(b) thereafter engaging the operating pump to pump liquid into the designated receptacle while drawing the designated volume of the desired chemical from the designated storage vessel into the suction conduit;

(c) thereafter, when a volume of liquid equal to the designated volume is indicated to have been pumped through the flow indicator, closing the inlet valve on the inlet conduit attached in fluid tight communication with the designated chemical storage vessel;

(d) thereafter opening the liquid flush valve and allowing sufficient liquid from the source of pressurized liquid to flow into the suction and discharge conduits to flush all of the desired liquid chemical past the gas flush conduit connection location;

(e) thereafter shutting down the operating pump and closing the liquid flush valve;

(f) thereafter opening the gas flush valve and allowing sufficient from the source of pressurized gas to flow into the discharge conduit and the dispensing conduit attached in fluid tight communication with the designated receptacle to flush all of the liquid within the discharge conduit and the dispensing conduit attached in fluid tight communication with the designated receptacle into the designated receptacle dispensing; and (g) thereafter closing the gas flush valve and closing the dispensing valve on the dispensing conduit attached in fluid tight communication with the designated receptacle.

18. A chemical dispensing system for dispensing a preselected quantity of liquid chemical drawn from one of a plurality of storage vessels and dispensing that quantity of liquid chemical to one of a plurality of receptacles using a single operating pump, the dispensing system comprising:

(a) a remote controllable primary pump having a suction side and a discharge side;

(b) a suction conduit having an upstream end, a midsection and a downstream end, the downstream end being in fluid tight communication with the suction side of the pump;

(c) a plurality of inlet conduits, each inlet conduit being adapted to receive a quantity of liquid chemical from one of the plurality of storage vessels and discharge such quantity of liquid chemical to the midsection of the suction conduit;

(d) a plurality of remote controllable inlet valves, one inlet valve being operatively disposed within each inlet conduit for controlling liquid flow therein;

(e) a discharge conduit having an upstream end, a midsection and a downstream end, the upstream end being in fluid tight communication with the discharge side of the pump;

(f) a plurality of dispensing conduits, each dispensing conduit being adapted to receive a quantity of liquid chemical from the downstream end of the discharge conduit and discharge such quantity of liquid chemical to one of the plurality of receptacles;

(g) a plurality of remote controllable dispensing valves, one dispensing valve being operatively disposed within each dispensing conduit for controlling liquid flow therein;

(h) a flow indicator operatively disposed within the upstream end of the discharge conduit for monitoring liquid flow therein, and generating a primary flow signal corresponding thereto;

(i) a liquid flush conduit having an upstream end and a downstream end, the upstream end being connected in fluid tight communication with a source of pressurized liquid and the downstream end being connected in fluid tight communication with the upstream end of the suction conduit;

(j) a remote controllable liquid flush valve operatively disposed within the liquid flush conduit for controlling liquid flow therein;

(k) a computerized controller programmed to (i) receive operating instructions regarding the transferring of a quantity of chemical from one of the storage vessels to one of the receptacles and to (ii) control the dispensing system in accordance with the operating instructions by operating the inlet valves, the pump, the dispensing valves and the liquid flush valve while receiving and using the primary flow signal as flow information feedback;

(l) a gas flush conduit having an upstream end and a downstream end, the upstream end being connected in fluid tight communication with a source of pressurized gas and the downstream end being connected in fluid tight communication with the midsection of the dispensing conduit at a connection location upstream of the dispensing conduits and downstream of the flow indicator; and (m) a remote controllable gas flush valve operatively disposed within the gas flush conduit for controlling gaseous flow therein;

wherein the computerized controller is programmed to control the dispensing system in accordance with operating instructions to dispense a designated volume of a desired chemical stored in a designated chemical storage vessel to a designated receptacle by causing the following steps to occur:

(n) opening the inlet valve on the inlet conduit attached in fluid tight communication with the designated chemical storage vessel and opening the dispensing valve on the dispensing conduit attached in fluid tight communication with the designated receptacle;

(o) thereafter operating the operating pump to pump liquid into the designated receptacle while drawing the designated volume of the desired chemical from the designated storage vessel into the suction conduit;

(p) thereafter, when a volume of liquid equal to the designated volume is indicated to have been pumped through the flow indicator, closing the inlet valve on the inlet conduit attached in fluid tight communication with the designated chemical storage vessel;

(q) thereafter opening the liquid flush valve and allowing sufficient liquid from the source of pressurized liquid to flow into the suction and discharge conduits to flush all of the desired liquid chemical past the gas conduit connection location;

(r) thereafter shutting down the operating pump and closing the liquid flush valve;

(s) thereafter opening the gas flush valve and allowing sufficient from the source of pressurized gas to flow into the discharge conduit and the dispensing conduit attached in fluid tight communication with the designated receptacle to flush all of the liquid within the discharge conduit and the dispensing conduit attached in fluid tight communication with the designated receptacle into the designated receptacle dispensing; and (t) thereafter closing the gas flush valve and closing the dispensing valve on the dispensing conduit attached in fluid tight communication with the designated receptacle.

19. A method for dispensing a preselected quantity of liquid chemical drawn from one of a plurality of storage vessels and dispensing that quantity of liquid chemical to one of a plurality of receptacles using a single operating pump, the method using a dispensing system comprising:

(a) a remote controllable operating pump having a suction side and a discharge side;

(b) a suction conduit having an upstream end, a midsection and a downstream end, the downstream end being in fluid tight communication with the suction side of the operating pump;

(c) a plurality of inlet conduits, each inlet conduit being adapted to receive a quantity of liquid chemical from one of the plurality of storage vessels and to discharge such quantity of liquid chemical to the midsection of the suction conduit;

(d) a plurality of remote controllable inlet valves, one inlet valve being operatively disposed within each inlet conduit for controlling liquid flow therein;

(e) a discharge conduit having an upstream end, a midsection and a downstream end, the upstream end being in fluid tight communication with the discharge side of the operating pump;

(f) a plurality of dispensing conduits, each dispensing conduit being adapted to receive a quantity of liquid chemical from the downstream end of the discharge conduit and to discharge such quantity of liquid chemical to one of the plurality of receptacles;

(g) a plurality of remote controllable dispensing valves, one dispensing valve being operatively disposed within each dispensing conduit for controlling liquid flow therein;

(h) a flow indicator operatively disposed within the upstream end of the discharge conduit for monitoring liquid flow therein, and generating a primary flow signal corresponding thereto;

(i) a liquid flush conduit having an upstream end and a downstream end, the upstream end being connected in fluid tight communication with a source of pressurized liquid and the downstream end being connected in fluid tight communication with the upstream end of the suction conduit;

(j) a remote controllable liquid flush valve operatively disposed within the liquid flush conduit for controlling liquid flow therein;

(k) a computerized controller programmed to (i) receive operating instructions regarding the transferring of a quantity of chemical from one of the storage vessels to one of the receptacles and to (ii) control the dispensing system in accordance with the operating instructions by operating the inlet valves, the operating pump, the dispensing valves and the liquid flush valve while receiving and using the primary flow signal as flow information feedback;

the method comprising the following steps:

(i) opening the inlet valve on the inlet conduit attached in fluid tight communication with the designated chemical storage vessel and opening the dispensing valve on the dispensing conduit attached in fluid tight communication with the designated receptacle;

(ii) thereafter engaging the operating pump to pump liquid into the designated receptacle while drawing the designated volume of the desired chemical from the designated storage vessel into the suction conduit;

(iii) thereafter, when a volume of liquid equal to the designated volume is indicated to have been pumped through the flow indicator, closing the inlet valve on the inlet conduit attached in fluid tight communication with the designated chemical storage vessel;

(iv) thereafter opening the liquid flush valve and allowing sufficient liquid from the source of pressurized liquid to flow into the suction and discharge conduits to flush all of the desired liquid chemical into the designated receptacle; and (v) thereafter shutting down the operating pump, closing the liquid flush valve and closing the dispensing valve on the dispensing conduit attached in fluid tight communication with the designated receptacle.

20. The method of claim 19 wherein the dispensing system of claim 19 further comprises:

(a) a gas flush conduit having an upstream end and a downstream end, the upstream end being connected in fluid tight communication with a source of pressurized gas and the downstream end being connected in fluid tight communication with the dispensing conduit at a connection location upstream of the dispensing conduits and downstream of the flow indicator; and (b) a remote controllable gas flush valve operatively disposed within the gas flush conduit for controlling gaseous flow therein; and wherein step (v) of the method comprises the steps of:

(1) shutting down the operating pump and closing the liquid flush valve;

(2) thereafter opening the gas flush valve and allowing sufficient gas from the source of pressurized gas to flow into the discharge conduit and the dispensing conduit attached in fluid tight communication with the designated receptacle to flush all of the liquid within the discharge conduit and the dispensing conduit attached in fluid tight communication with the designated receptacle into the designated receptacle dispensing; and (3) thereafter closing the gas flush valve and closing the dispensing valve on the dispensing conduit attached in fluid tight communication with the designated receptacle.

* * * * *